US009787010B1

(12) United States Patent
Takahira

(10) Patent No.: US 9,787,010 B1
(45) Date of Patent: Oct. 10, 2017

(54) ELECTRICAL CONNECTOR AND METHOD

(71) Applicant: Yamaichi Electronics USA, Inc., San Jose, CA (US)

(72) Inventor: Hiroshi Takahira, Sunnyvale, CA (US)

(73) Assignee: YAMAICHI ELECTRONICS USA, INC., San Jose, CA (US)

( * ) Notice: Subject to any disclaimer, the term of this patent is extended or adjusted under 35 U.S.C. 154(b) by 0 days.

(21) Appl. No.: 15/460,788

(22) Filed: Mar. 16, 2017

Related U.S. Application Data

(60) Provisional application No. 62/309,197, filed on Mar. 16, 2016.

(51) Int. Cl.

| | |
|---|---|
| ***H01R 13/62*** | (2006.01) |
| ***H01R 12/72*** | (2011.01) |
| ***H01R 12/52*** | (2011.01) |
| ***H01R 12/70*** | (2011.01) |

(52) U.S. Cl.
CPC ..... *H01R 12/721* (2013.01); *H01R 12/52* (2013.01); *H01R 12/7023* (2013.01); *H01R 12/724* (2013.01)

(58) Field of Classification Search
CPC ..... H01R 13/6271; H01R 13/6275
USPC ..... 439/325, 327, 328, 260
See application file for complete search history.

(56) References Cited

U.S. PATENT DOCUMENTS

| | | | | |
|---|---|---|---|---|
| 5,174,779 | A | 12/1992 | Chung | |
| 6,192,557 | B1 | 2/2001 | Fujisawa | |
| 8,444,427 | B2 * | 5/2013 | Hashimoto | H01R 12/774 439/325 |

FOREIGN PATENT DOCUMENTS

| | | | |
|---|---|---|---|
| JP | H10-92531 | | 4/1998 |
| JP | 2014-192134 | A | 10/2014 |
| WO | WO 98/54794 | | 12/1998 |
| WO | WO 2014/157614 | A1 | 10/2014 |

OTHER PUBLICATIONS

International Search Report and Written Opinion dated Jun. 8, 2017 in International Patent Application No. PCT/US2017/022793, 12 pages.

* cited by examiner

*Primary Examiner* — Phuong Dinh
(74) *Attorney, Agent, or Firm* — Squire Patton Boggs (US) LLP

(57) ABSTRACT

An electrical connector has at least one latch that is rotatable on the connector body to allow a module board to be clamped between an upper clamp surface of the latch and a lower clamp surface of the connector body. The electrical connector has connector pins having contact points within an opening of the connector body. When a module board is inserted into the opening, the contact points are pushed from a first height elevation to a second height elevation, which is level with the lower clamp surface.

20 Claims, 13 Drawing Sheets

ELECTRICAL CONNECTOR AND METHOD

CROSS-REFERENCE TO RELATED APPLICATION

This application claims priority to U.S. Provisional Application No. 62/309,197, filed Mar. 16, 2016, which is incorporated herein by reference.

FIELD

This disclosure relates generally to electrical connectors, more particularly, electrical connectors used for printed circuit boards and the like.

BACKGROUND

Electronic assemblies often include one or more module boards which carry electronic components. As shown in FIG. 1, module boards 10, such as printed circuit boards (PCB) and printed wiring boards (PWB) as non-limiting examples, have electrical contacts 12 which must be electrically connected to other boards or components. Electrical connectors 14 are used to make the electrical connection. Conventional connectors are able to provide reliable electrical connections in environments with minimal dynamic movement, such as vibration and mechanical shock. However, module boards are being used more and more in environments, such as automobiles, in which they are subjected to severe dynamic movement. There is increasing demand for automotive functions that are enabled by electronic components. Such functions include navigation systems, power management for hybrid and electric powertrains, and autonomous parking and driving. As such, module boards are designed to carry an increasing number of electronic components, some of which, like power supplies, can be relatively massive. A heavier module board develops higher reaction forces when subjected to large vibrations and mechanical shocks, which decreases the reliability of its electrical connections. Even if the module board remains attached to the electrical connector, one or more of the electrical connections may be momentarily lost. Thus, there is a need for an electrical connector which provides reliable electrical connections in high vibration and mechanical shock environments.

SUMMARY

Briefly and in general terms, the present invention is directed to an electrical connector, electronic assembly, and method of establishing an electrical connection.

In aspects of the invention, an electrical connector comprises a connector body, a row of lower connector pins, a first lower clamp surface, and a first latch. The connector body includes a body left end, a body right end, and a front face, there being an opening formed through the front face, the opening having an opening left end and an opening right end. The row of lower connector pins is located between the opening left end and the opening right end, each of the lower connector pins having a contact point, the contact points being level with a first height elevation, the lower connector pins configured to flex to allow the contact points to move from the first height elevation to a second height elevation. The first lower clamp surface extends from the connector body, the first lower clamp surface located in front of the front face and level with the second height elevation. The first latch is attached to and configured to rotate relative to the connector body, the first latch rotatable from an open position to a closed position, the first latch including a first upper clamp surface. When the first latch is at its closed position, the first upper clamp surface is at a distance away from the first lower clamp surface that is reduced from when the first latch is at its open position, the first upper clamp surface is level with a third height elevation, and the first height elevation is between the second and third height elevations.

In aspects of the invention, an electronic assembly comprises the electrical connector and a host board on which the electrical connector is mounted.

In aspects of the invention, a method comprises inserting a module board into an opening of a connector body, during which the module board pushes contact points of a row of flexible connector pins from a first height elevation to a second height elevation; and rotating a first latch attached to the connector body from an open position to a closed position such that the module board is between a first upper clamp surface of the first latch and a first lower clamp surface extending from the connector body, the first upper clamp surface being level with a third height elevation, and the first lower clamp surface being level with the second height elevation, and the first height elevation is between the second and third height elevations.

The features and advantages of the invention will be more readily understood from the following detailed description which should be read in conjunction with the accompanying drawings.

DETAILED DESCRIPTION

Directional terms such as left, right, upper, lower, and the like are used herein for clarity and ease of understanding. The directional terms are taken from the perspective of the example illustrations herein and do not necessarily refer the perspective of the user. For example, a connector may be mounted upside down, vertically, or at an angle. When upside down, parts of connector 26 described as "upper" herein may appear at a lower region of connector 26, and parts described as "left" herein may appear at a right side of connector 26. Thus, it is to be understood that the directional terms do not limit the invention to being used in a particular orientation.

Figure 1:
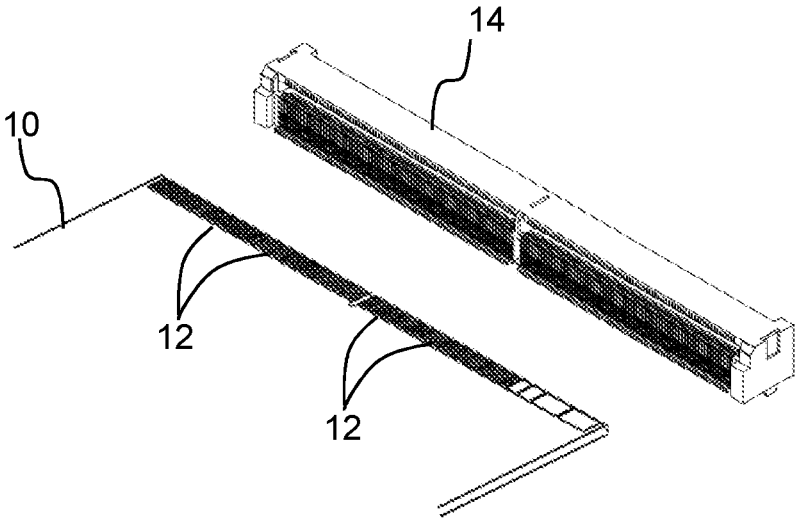
FIG. 1 (prior art)
FIG. 1 is a perspective view showing a prior electrical connector.
Figure 2A:
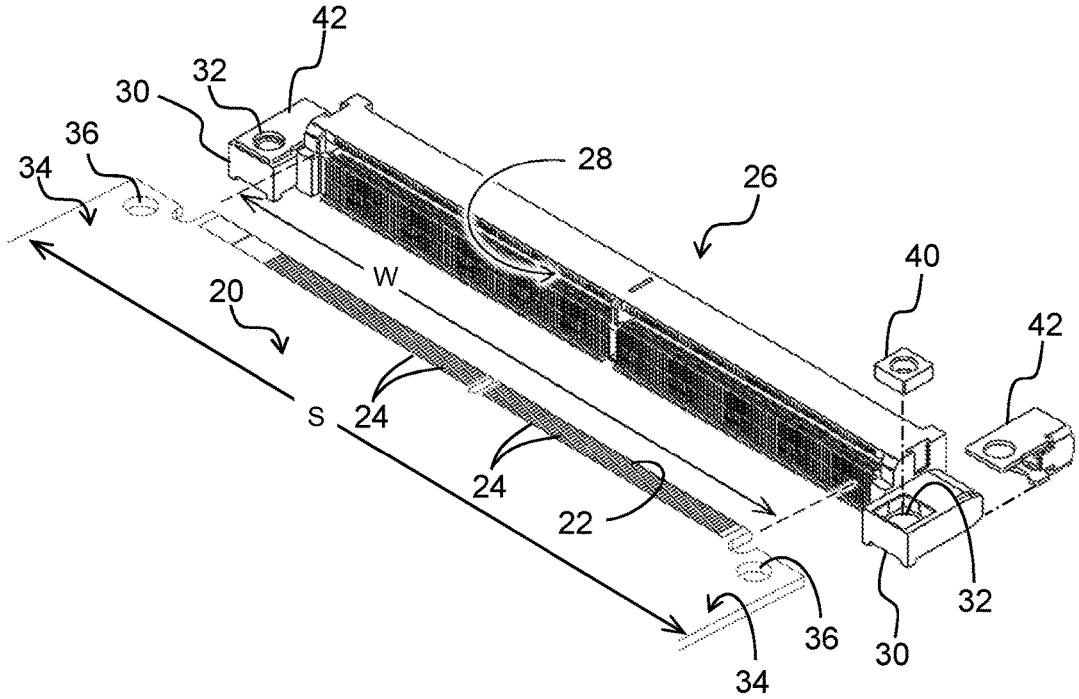
FIGS. 2A and 2B are perspective views showing an electrical connector with a means for holding a module board.
Figure 2B:
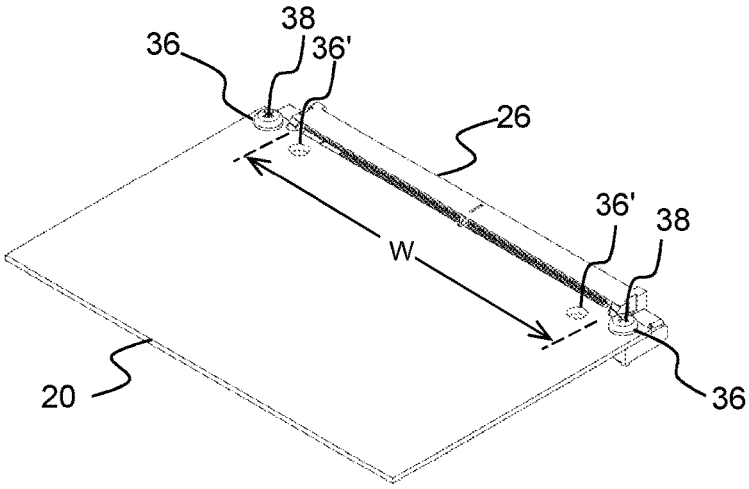

Referring now in more detail to the drawings for purposes of illustrating aspects of the invention, wherein like reference numerals designate corresponding or like elements among the several views, there is shown in FIGS. 2A and 2B example module board 20 that includes forward edge 22 having electrical contacts 24, which may number in the tens to hundreds, so it is important to prevent movement of module board 20 relative to connector 26 during vibration and mechanical shocks so that all electrical connections are maintained at all times. Connector 26 includes opening 28 sized to receive forward edge 22 of module board 20. Connector 26 includes arms 30 having holes 32, which will be used to secure module board 20 so that electrical connections are not interrupted during vibration and mechanical shocks. Module board 20 includes large extension areas 34 on the left and right of forward edge 22. Holes 36 are formed through large extension areas 34.

Electrical connections are established by inserting forward edge 22 of module board 20 into opening 28 of connector 26. When inserted, holes 32 and 36 become aligned, and screws 38 are placed into the holes. Screw 38 engages nut 40 which is held on each arm 30 by clip 42. Screws 38 clamp extension areas 34 of module board 20 in place.

The width dimensions W of forward edge 22 of the module board and opening 28 of the connector are often standardized in the electronics industry, which allows module boards to be compatibility with connectors from a variety of different connector manufacturers. As such, it is often the case that that the side-to-side dimension S of other module boards (see FIGS. 3A and 3B) are the same as or nearly the same as the standardized width dimension W. Such module boards will not have extension areas 34 of sufficient size to accommodate screws 38 and will not be fully compatible with connector 26 of FIGS. 2A and 2B.

In another embodiment, arms 30 of a connector would be reconfigured so that the holes in the arms would be located below predetermined areas of module board 20 within its width dimension W. That is, in the absence of large extension areas 34, the location of holes 36 would be moved to the location of 36' (FIG. 2B). Such a connector would be fully compatible with a module board that already has or is capable of having holes drilled at the predetermined areas within width dimension W. However, it may be undesirable to reserve valuable space for holes within width dimension W of a module board, particularly when the module board must have a very large number of components.

Figure 3A:
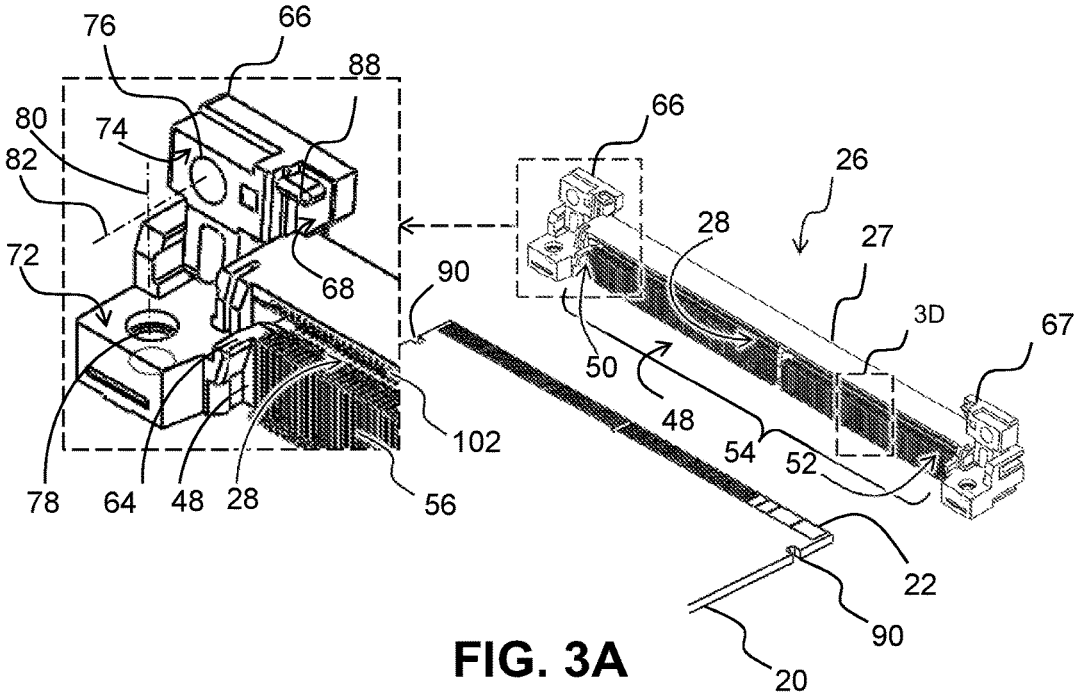
FIGS. 3A and 3B are perspective views showing an electrical connector with another means for holding a module board.

Connectors 26 shown in FIG. 3A and subsequent figures are intended to be compatible with a great variety of module boards by not requiring a large extension area on either side of width dimension W for securing the module board onto the connector and by not requiring additional holes to be placed within width dimension W for securing the module board onto the connector.

Figure 3B:
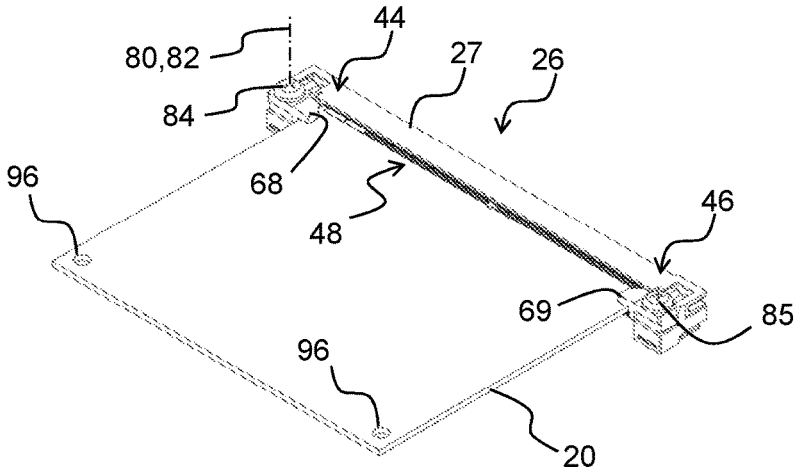
Figure 3C:
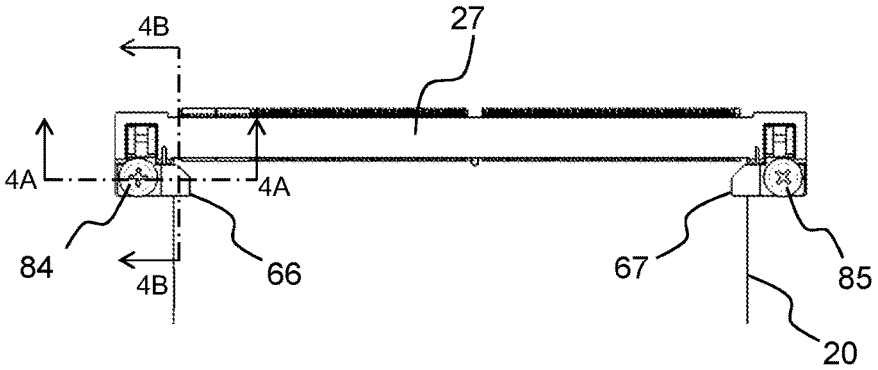
FIG. 3C is a plan view of the electrical connector of FIG. 3B.

In FIGS. 3A and 3B, connector 26 includes connector body 27 made of electrically non-conductive material. Connector body 27 includes body left end 44, body right end 46, and front face 48. Opening 28 is formed through front face 48. Opening 28 has opening left end 50 and opening right end 52.

Figure 3D:
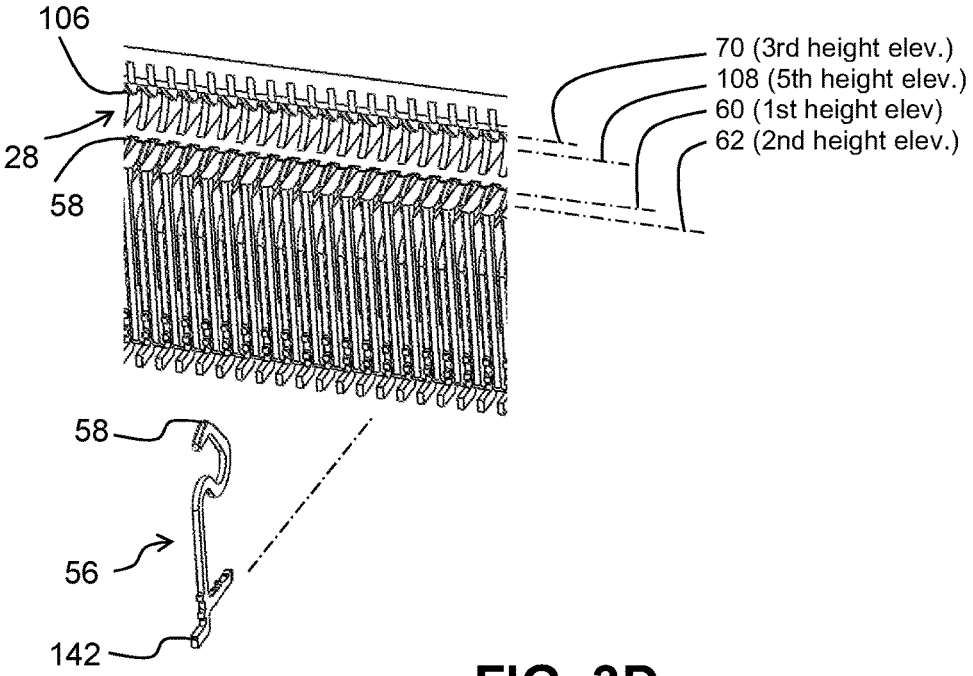
FIG. 3D is a detail view of box 3D in FIG. 3A, showing one connector pin removed.
Figure 4A:
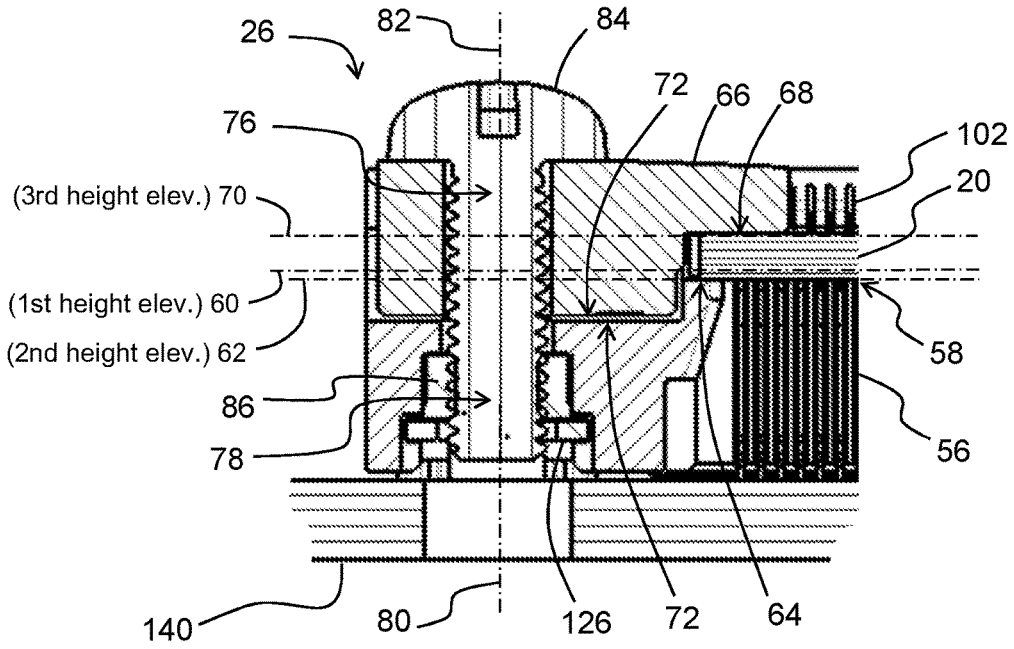
FIG. 4A is a partial section view along line 4A-4A in FIG. 3C.
Figure 7A:
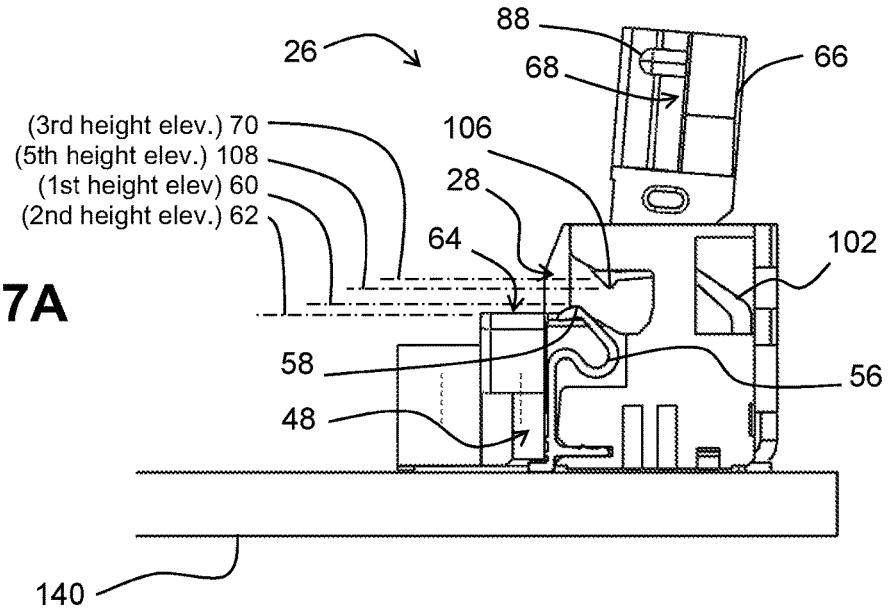
FIGS. 7A and 7B are partial section views along line 7-7 in FIG. 6.

Row 54 of lower connector pins 56 is located between opening left end 50 and opening right end 52. There may be at least ten, at least 50, or at least 100 lower connector pins 56. Each lower connector pin 56 has lower contact point 58 (FIGS. 3D and 7A) arranged within opening 28 to make contact with electrical contacts on the lower surface of module board 20. Lower contact points 58 are level with first height elevation 60 (FIGS. 4A and 7A). Lower connector pins 56 are made of metal and are configured to flex to allow contact points 58 to move from first height elevation 60 to second height elevation 62 (FIGS. 4A and 7A). The movement distance from first height elevation 60 to second height elevation 62 may be less than 2 mm or less than 1 mm, as non-limiting examples.

First lower clamp surface 64 is fixedly attached to connector body 27. For example, first lower clamp surface 64 may be integrally formed on connector body 27, such as by injection molding. First lower clamp surface 64 is located in front of front face 48 and is level with second height elevation 62 (FIGS. 4A and 7A).

First latch 66 is movably attached to and is configured to rotate relative to connector body 27. First latch 66 is rotatable from an open position (FIG. 3A) to a closed position (FIG. 3B). First latch 66 includes first upper clamp surface 68. In FIG. 3A, first upper clamp surface 68 is behind front face 48 when first latch 66 is at its open position. This is also shown later in FIG. 7A.

In FIG. 3B, first upper clamp surface 68 is in front of the front face 48 when first latch 66 is at its closed position. First upper clamp surface 68 is at a distance away from the first lower clamp surface 64 that is reduced from when first latch 66 is at its open position. Also, first upper clamp surface 68 is level with third height elevation 70 (FIG. 4A). First height elevation 60 is between second height elevation 62 and third height elevation 70.

Referring again to FIG. 3A, first lower stop surface 72 is fixedly attached to connector body 27. For example, first lower stop surface 72 may be integrally formed on connector body 27, such as by injection molding. First latch 66 includes first upper stop surface 74. First lower stop surface 72 and first upper stop surface 74 are spaced apart when first latch 66 is at its open position (FIG. 3A) and closed position (FIGS. 3B and 4A).

First upper through-hole 76 extends through first latch 66 and first upper stop surface 74. First lower through-hole 78 extends through first lower stop surface 72. Central axes 80, 82 of first upper through-hole 76 and first lower through-hole 78 are not aligned when first latch 66 is in its open position (FIG. 3A). Central axes 80, 82 are aligned when first latch 66 is in its closed position (FIGS. 3B and 4A).

Helical threads may be disposed in one or both of first upper through-hole 76 and first lower through-hole 78. The helical threads are configured to engage threads on a screw (discussed below) so that a module board can be clamped onto connector 26. The helical threads may be provided by a nut installed in through-hole 76 and/or 78, or the helical threads may be integrally formed on interior walls of through-hole 76 and/or 78. Alternatively, helical threads can be absent from one or both of first upper through-hole 76 and first lower through-hole 78.

Figure 4B:
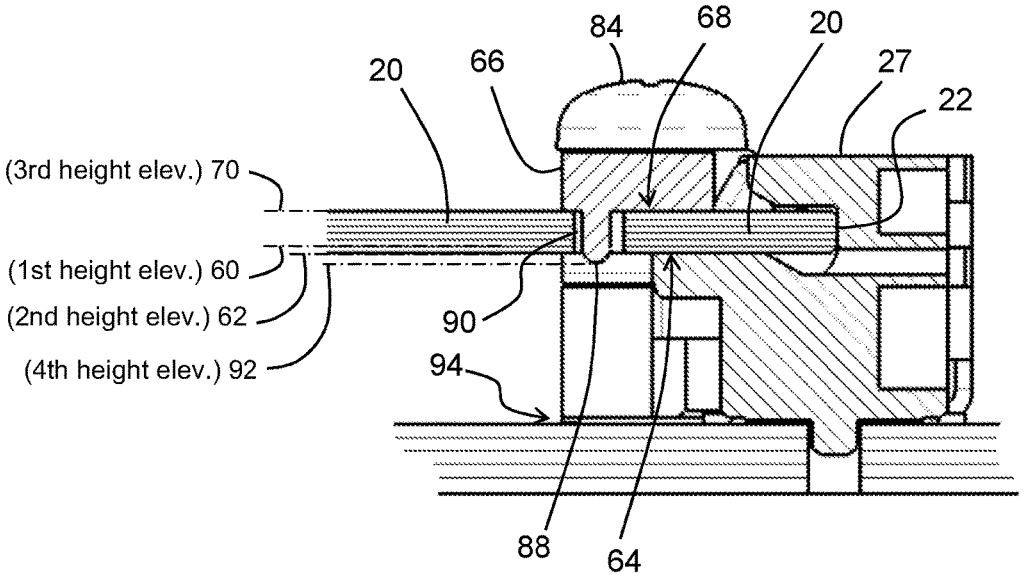
FIG. 4B is a partial section view along line 4B-4B in FIG. 3C.

In FIGS. 4A and 4B, first latch 66 is in its closed position while forward edge 22 of module board 20 is inserted into opening 28 (FIG. 3B) of connector body 27. Module board 20 is disposed between and is in contact with first lower lamp surface 64 and first upper clamp surface 68. First screw 84 has been installed to help secure module board 20 against movement due to vibration and mechanical shock. First screw 84 is sized to fit into first upper through-hole 76 and first lower through-hole 78. Helical threads are provided in first lower through-hole 78 by nut 86 secured below first lower stop surface 72. Screw 84 engages the helical threads of nut 86. Helical threads are absent from first upper through-hole 76 so that screw 84 can push first latch 66 downward, which causes first latch 66 (specifically, first upper clamp surface 68) to apply pressure onto module board 20 which rests on top of first lower clamp surface 64. First lower clamp surface 64 is level with second height elevation 62, which is the same elevation at which contact points 58 of lower connector pins 56 of connector 26 push against the bottom surface of module board 20. Thus, pressure applied by first latch 66 on module board 20 can help electrical contacts at the bottom surface of module board 20 maintain continuous contact with lower connector pins 56 of connector 26.

Still referring to FIG. 4A, first lower stop surface 72 and first upper stop surface 74 are spaced apart so that downward pressure is applied by first latch 66 to the top surface of module board 20. In the absence of module board 20, first latch 66 is capable of moving further downward than what is shown in FIG. 4A. That is, in the absence of module board 20, first latch is movable from the closed position (FIG. 4A) to a stopped position. At the stopped position, first lower stop surface 72 and first upper stop surface 74 will be in contact, and first upper clamp surface 68 will be at a distance away from first lower clamp surface 64 that is reduced from when first latch 66 is at its closed position.

Referring again to FIG. 4B, first latch 66 includes first tip 88 adjacent to first upper clamp surface 68. First tip 88 is received within slot 90 (FIG. 3A) formed through a side edge of module board 20. First tip 88 can prevent module board 20 from sliding out of connector 26. First tip 88 will be level with fourth height elevation 92 when first latch 66 is at its closed position. Fourth height elevation 92 is between third height elevation 70 and bottom face 94 of connector body 27.

It is also possible for first tip 88 to be absent from first latch 66. In the absence of first tip 88, module board 20 may be prevented from sliding out of connector 26 by other means. For example, one end of module board 20 (opposite forward edge 22) may be supported by another structure, such as screws passing through rear holes 96 (FIG. 3B), which may also prevent module board 20 from sliding away from connector 26.

As shown in FIG. 4B, first upper clamp surface 68 and first lower clamp surface 64 are flat. First upper clamp surface 68 and first lower clamp surface 64 are parallel when first latch 66 is at its closed position. First upper clamp surface 68 and first lower clamp surface 64 are not parallel when first latch 66 is at its open position, as shown in FIG. 3A.

Figure 5A:
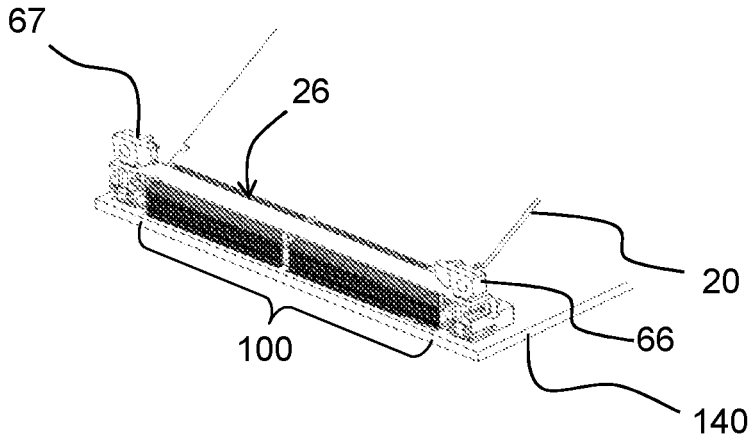
FIGS. 5A and 5B are perspective views showing the rear of the electrical connector of FIGS. 3A and 3B.
Figure 5B:
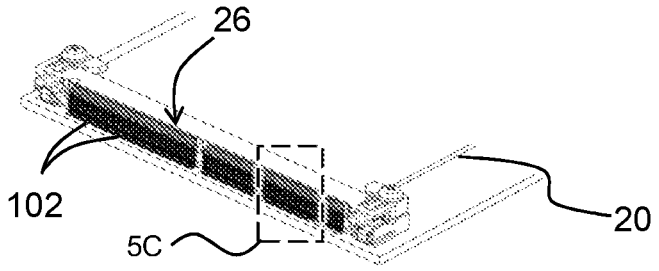
Figure 5C:
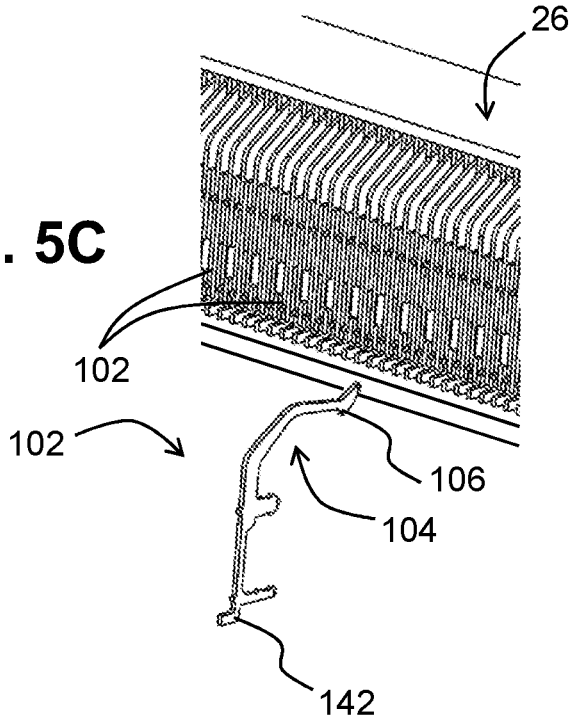
FIG. 5C is a detail view of box 5C in FIG. 5B, showing one connector pin removed.

FIGS. 5A to 5C show the rear of connector 26. In FIG. 5A, forward edge 22 of module board 20 is inserted at a non-horizontal angle into opening 28 of connector 26. In FIG. 5B, module board 20 is rotated from the non-horizontal orientation to a horizontal orientation while forward edge 22 is inside opening 28. Such rotation of module board 20 helps to push lower contact points 58 of lower connector pins 56 downward from first height elevation 60 to second height elevation 62. FIG. 5C shows an enlarged view of a rear section of connector 26.

Connector 26 optionally comprises row 100 of upper connector pins 102. There may be at least ten, at least 50, or at least 100 lower upper connector pins 102. Upper connector pins 102 are made of metal and extend from the rear of connector 26 to opening 28 at front face 48. Upper connector pins 102 include forward segments 104 which are located between opening left end 50 and opening right end 52 (FIG. 3A). Each upper connector pin 102 has upper contact point 106 arranged within opening 28 to make contact with electrical contacts on the upper surface of module board 20.

Referring again to FIG. 3D, upper contact points 106 are level with fifth height elevation 108 in the absence of module board 20. Upper connector pins 102 are configured to flex to allow upper contact points 106 to move from fifth height elevation 108 to third height elevation 70 when module board 20 is fully installed in opening 28. Rotation of module board 20 from the non-horizontal orientation (FIG. 5A) to a horizontal (FIG. 5B) may also help to push upper contact points 106 of upper connector pins 102 upward from fifth height elevation 108 to third height elevation 70. The movement distance from fifth height elevation 108 to third height elevation 70 may be less than 2 mm or less than 1 mm, as non-limiting examples. Fifth height elevation 108 is between second height elevation 62 and third height elevation 70. Second height elevation 62 corresponds to the location of first lower clamp surface 64 which supports the bottom surface of module board 20. Third height elevation 70 corresponds to the location of the top surface of module board 20 on which pressure is applied by first upper clamp surface 68.

Connector 26 optionally includes second latch 67, as illustrated in the figures. Second latch 67 is a mirror image of first latch 66. All descriptions herein for and related to first latch 66 apply to second latch 67. Connector 26 optionally includes second lower clamp surface 65 (FIG. 6), which is a mirror image of first lower clamp surface 64. All descriptions herein for and related to first lower clamp surface 64 apply to second lower clamp surface 65. Also, all descriptions herein for first upper clamp surface 68, first lower stop surface 72, first upper stop surface 74, first upper through-hole 76, first lower through-hole 78, first screw 84, and first tip 88 apply to second upper clamp surface 69, second lower stop surface 73, second upper stop surface 75, second upper through-hole 77, second lower through-hole 79, second screw 85, and second tip 89.

Figure 6:
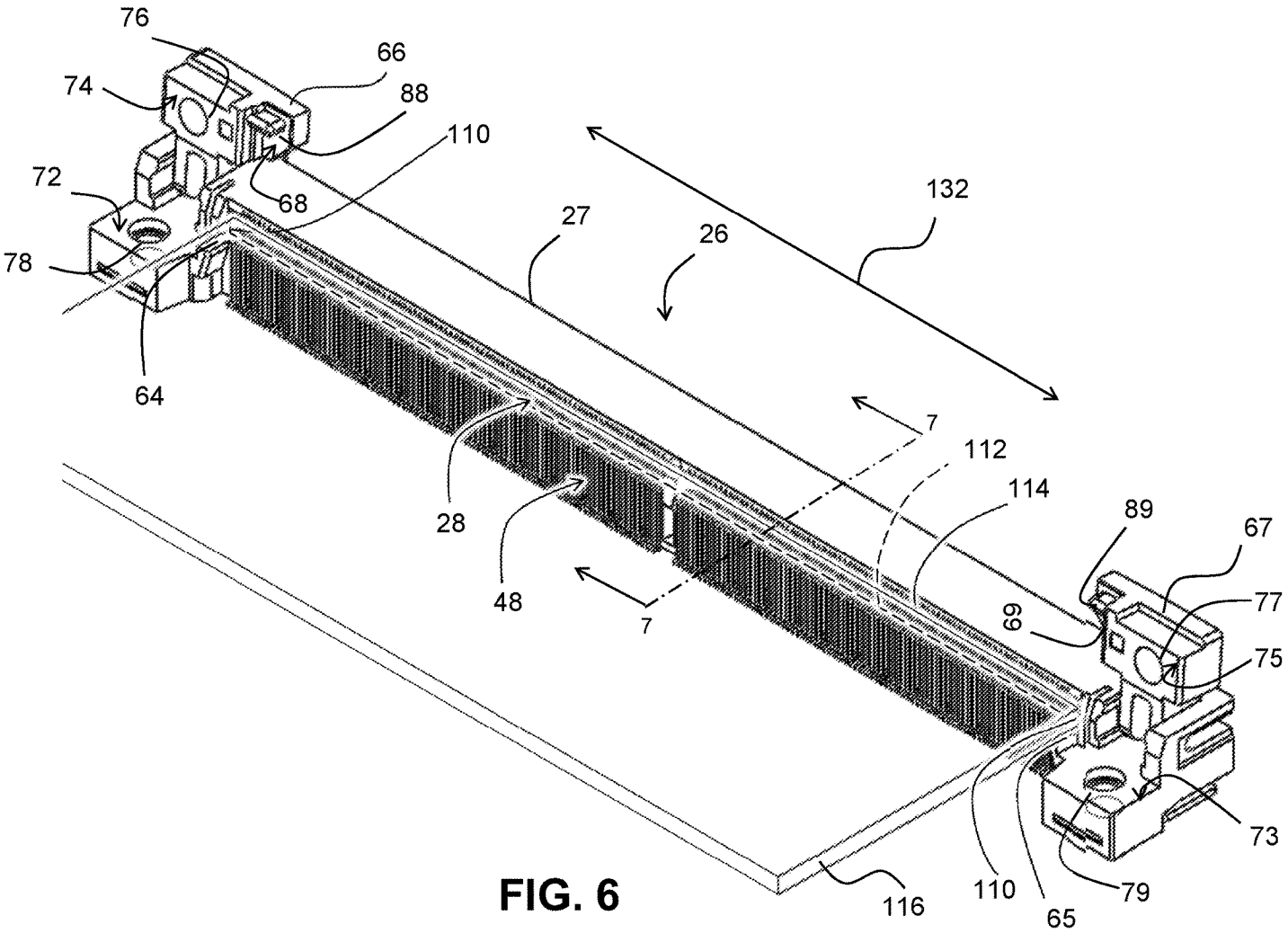
FIG. 6 is an enlarged, perspective view of the electrical connector of FIG. 3A.

As shown in FIG. 6, second lower clamp surface 65 fixedly attached to body right end 46. For example, second lower clamp surface 65 may be integrally formed on connector body 27, such as by injection molding. Second lower clamp surface 65 is located in front of the front face 48 of connector body 27 and is level with second height elevation 62. Second latch 67 is movably attached to body right end 46 (FIG. 3B) and is configured to rotate relative to connector body 27. Second latch 67 is rotatable from an open position to a closed position. Second latch 67 includes second upper clamp surface 69. When second latch 67 is at its closed position (FIG. 3B), second upper clamp surface 69 is at a distance away from second lower clamp surface 65 that is reduced from when second latch 67 was at its open position (FIG. 3A), and second upper clamp surface 69 is level with third height elevation 70.

The figures herein illustrate various features with descriptor "first" located on the left side of connector 26. For example, first lower clamp surface 64, first latch 66, first upper clamp surface 68, first lower stop surface 72, first upper stop surface 74, first upper through-hole 76, first lower through-hole 78, and first tip 88 are located on the left side of connector 26. Corresponding features with the descriptor "second" are illustrated on the right side of connector 26. However, the descriptor "first" may instead be used for the features located on right side of connector 26, and the descriptor "second" may instead be used for the features located on left side of connector 26. Thus, descriptors "first" and "second" are not to be interpreted as being limited to left and right, respectively.

Referring again to FIG. 6, opening 28 is a rectangle having rectangle side boundaries 110, rectangle bottom boundary 112, and rectangle top boundary 114. Rectangle side boundaries 110 are defined by opening left end 50 (FIG. 3A) and opening right end 52 (FIG. 3A). Rectangle bottom boundary 112 is defined by second height elevation 62 (FIG. 4A). Rectangle top boundary is defined by the third height elevation 70 (FIG. 4A). The distance from second height elevation 62 to third height elevation 70 can be less than 5 mm or less than 3 mm, as non-limiting examples. The rectangle defines a cross-section of rectangular prism 116 of empty space that extends in front of and into the front face 48 of connector body 27 and is capable of receiving a module board. Contact points 58 and 106 (FIG. 3D) of the connector pins protrude slightly into the empty space of rectangular prism.

First tip 88 of first latch 66 is outside of rectangular prism 116 of empty space when first latch 66 is at its open position, as shown in FIG. 6. When first latch 66 is moved to its closed position, first tip 88 will protrude into rectangular prism 116 of empty space. In use, module board 20 will be installed in the empty space of rectangular prism 116, and first tip 88 will protrude into slot 90 (FIG. 3A) of module board 20, as previously discussed.

When first latch 66 is moved in the opposite direction (from its closed position to its open position), no part of first latch 66 pushes the module board out of opening 28 because one end of module board 20 (opposite forward edge 22) may still be held by another structure, such as screws passing through rear holes 96 (FIG. 3B), as previously discussed. Thus, it may be desirable in some aspects that no part of connector 26 moves into or moves further into rectangular prism 116 of empty space when first latch 66 is moved from its closed position to its open position.

Figure 7B:
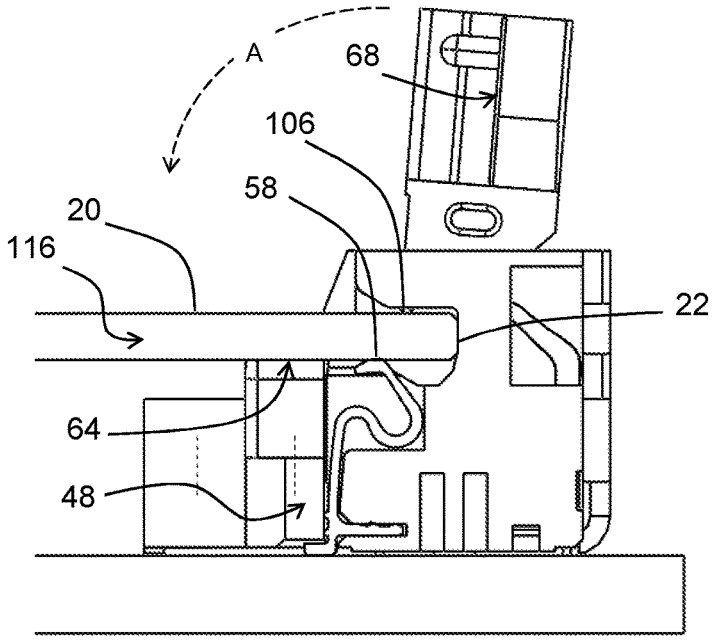

FIGS. 7A and 7B illustrate the relationship of the various height elevations relative to lower connector pins 56 and upper connector pins 102. In FIG. 7A, with the module board absent, lower connector pins 56 and upper connector pins 102 are at their normal state. At the normal state, lower contact point 58 of each lower connector pin 56 is level with first height elevation 60, and upper contact point 106 of each upper connector pin 102 is level with fifth height elevation 108. In FIG. 7B, lower connector pins 56 and upper connector pins 102 are at their flexed state when module board 20 is installed within rectangular prism 116 (FIG. 6) of empty space that extends in front of and into the front face 48 of connector body 27. At the flexed state, lower contact point 58 of each lower connector pin 56 is level with second height elevation 62, and upper contact point 106 of each upper connector pin 102 is level with third height elevation 70. Lower contact points 58 press against electrical contacts at the bottom surface of module board 20. Upper contact points 106 press against electrical contacts at the top surface of module board 20. Thereafter, first latch 66 is rotated in the direction of arrow A so that module board 20 is clamped between first upper clamp surface 68 and first lower clamp surface 64.

Figure 8:
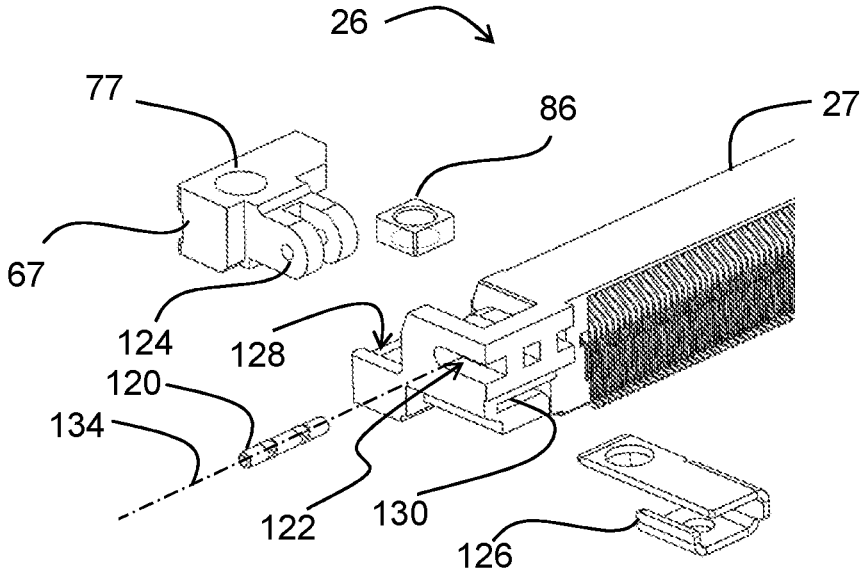
FIGS. 8 and 9 are perspective, exploded views showing various means for connecting a latch onto a connector body.
Figure 9:
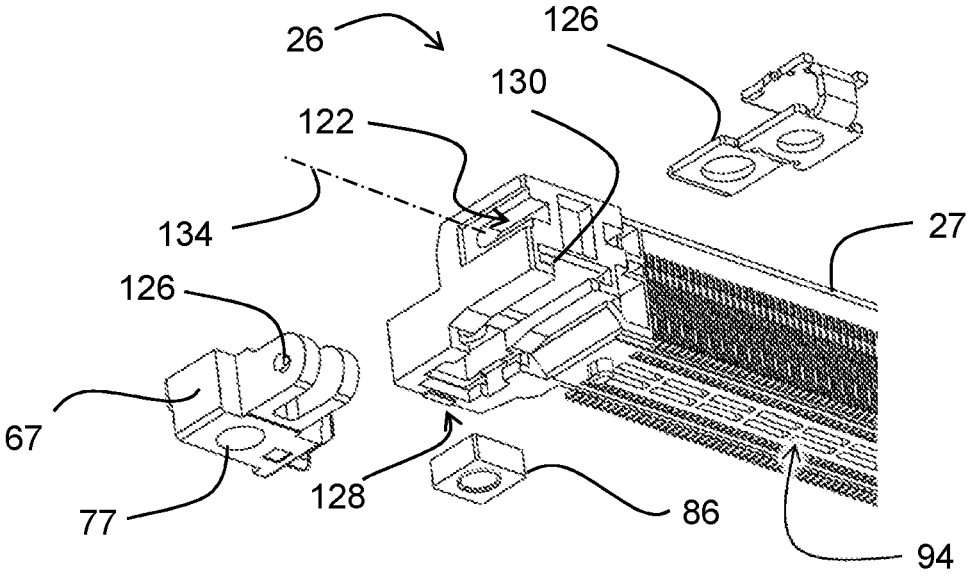

First and second latches 66, 67 may be movably attached to connector body in various ways. As shown in FIG. 8, the latch may be secured with hinge pin 120 which passes through recess 122 formed into connector body 27 and holes 124 in the latch. As shown in FIG. 9, hinge post 126 may be formed on the latch, and hinge post 126 is held within recess 122 formed into connector body 27.

As previously discussed, nut 86 is held within connector body 27 to provide helical threads on which screws 84, 85 may engage to clamp the latch onto a module board. Clip 126 retains nut 86 within nut recess 128 formed in connector body 27. Clip 126 is retained within clip slot 130 formed into connector body 27. Nut recess 128 may be open from above, as shown in FIG. 8. Nut recess 128 may be open from below, as shown in FIG. 9.

In FIGS. 8 and 9, hinge pin 120 and hinge post 126 are axially oriented in a direction that is parallel to major axis 132 (FIG. 6) of connector body 27. Major axis 132 is the axis that runs from body left end 44 to body right end 46 (FIG. 3B) and vice versa. The result is that pivot axes 134 of the latches described above are parallel to major axis 132.

Alternatively, the latches may be movably attached to connector body 27 such that pivot axes 134 of the latches are not parallel to major axis 132. As shown in FIGS. 10A to 11B, pivot axes 134 of latches 66, 67 may be perpendicular to major axis 132. It is to be understood that descriptions for FIGS. 3A to 9 apply to FIGS. 10A to 11B unless clearly indicated below.

Figure 10A:
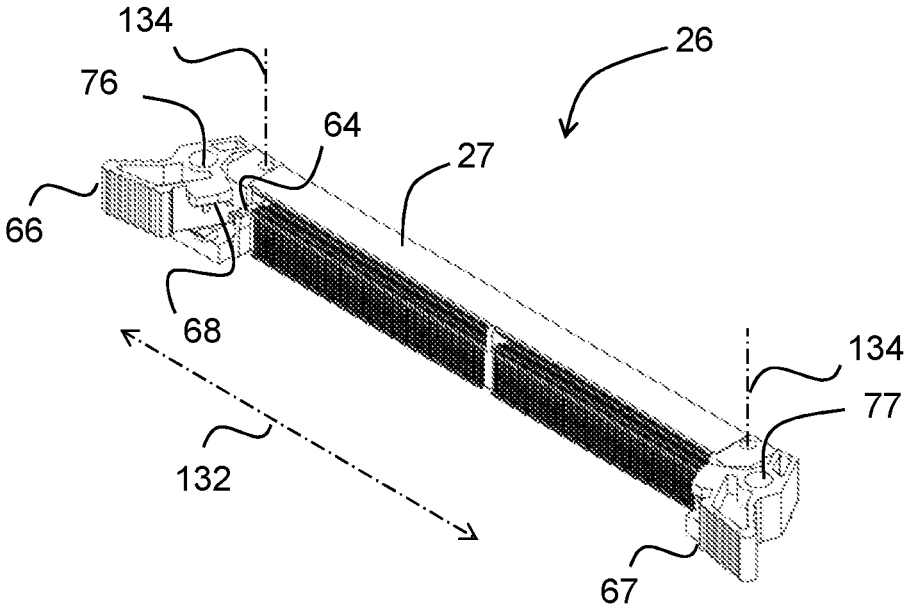
FIGS. 10A and 10B are perspective views showing another means for connecting a latch onto a connector body.
Figure 10B:
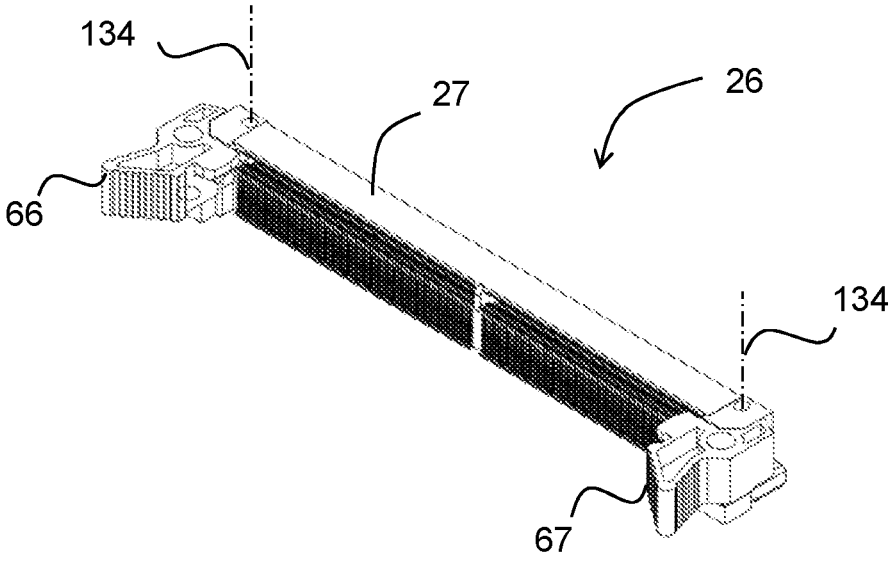
Figure 10C:
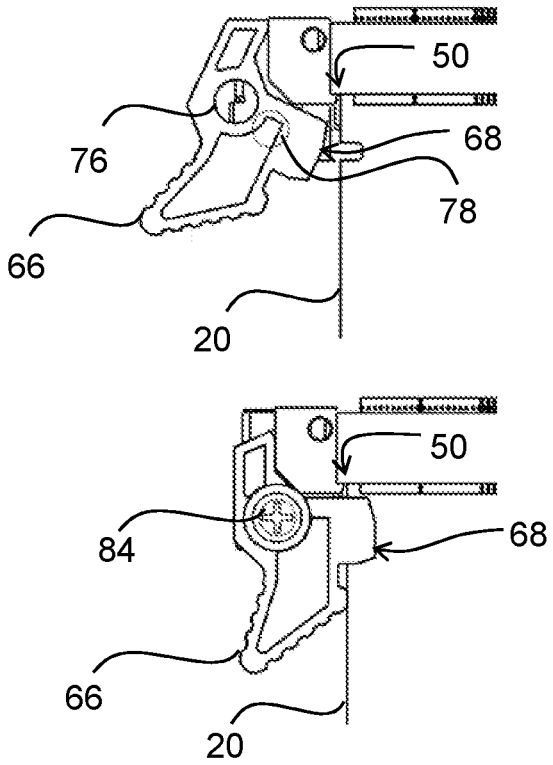
FIG. 10C is a plan view of the connector body of FIGS. 10A and 10B.

In FIG. 10A, latches 66, 67 are in their open position. In FIG. 10B, latches 66, 67 are in their closed position. FIG. 10C shows the sequence of movement from the open position to the closed position. In the closed position, through-holes 76, 78 in the latch and lower stop surface are not aligned. In the closed position, through-holes 76, 78 are aligned to allow installation of screw 84 which causes the latch to clamp down onto module board 20.

Figure 11A:
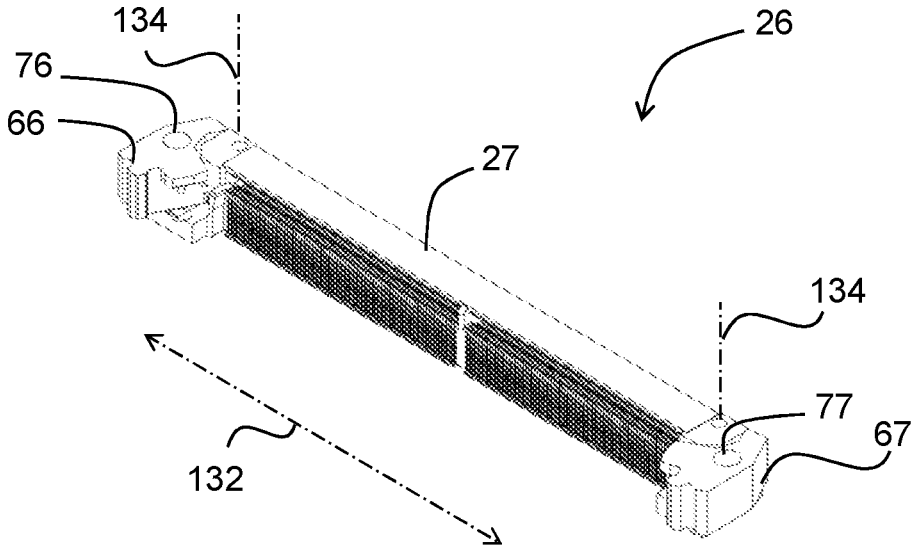
FIG. 11A is a perspective view showing other means for connecting a latch onto a connector body.
Figure 11B:
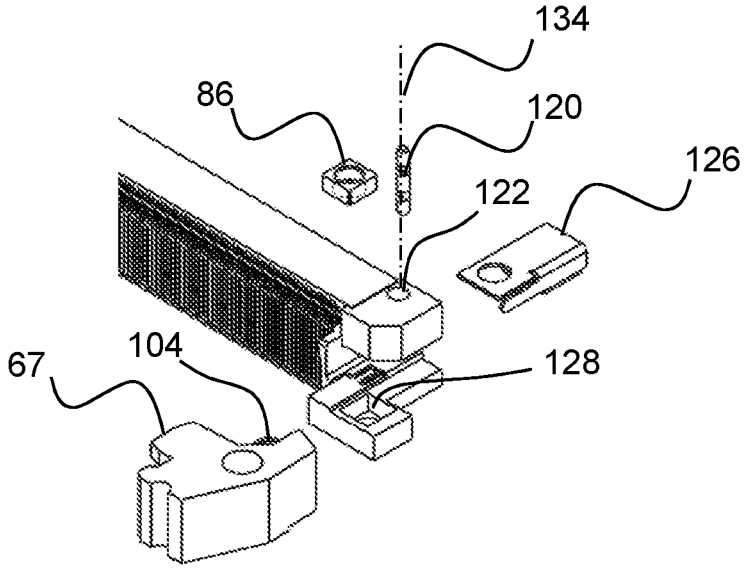
FIG. 11B is an exploded view showing the connection means of FIG. 11A.

In FIGS. 11A and 11B latches 66, 67 function as in FIG. 10A although they have a slightly different exterior appearance. As shown in FIG. 11B, the latches may be secured with hinge pin 120 which passes through recess 122 formed into connector body 27 and holes 104 in the latch. As an alternative to hinge pin 120, a hinge post may be formed on the latch, and the hinge post may be held within recess 122.

As shown in FIG. 11B, nut 86 is held within connector body 27 to provide helical threads on which screws may engage to clamp the latch onto a module board. Clip 126 retains nut 86 within nut recess 128 formed in connector body 27. Nut recess 128 may be open from above, as shown in FIG. 11B, or it may be open from below instead.

A difference between FIGS. 3A to 9 versus FIGS. 10A to 11B is that in FIGS. 10A to 11B, is possible for upper clamp surface 68 and the lower clamp surface 64 to be parallel when first latch 66 is at its open position and closed position. Also, as shown in FIG. 10C, it is possible for first upper clamp surface 68 to be located at one side of opening left end 50 when first latch 66 is at its open position, and then first upper clamp surface 68 is at an opposite side of opening left end 50 when first latch 66 is at its closed position.

Figure 12:
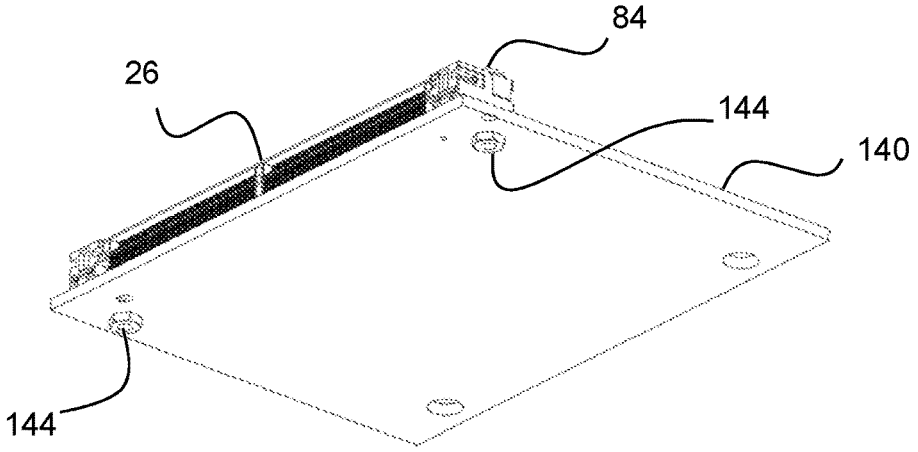
FIG. 12 is a perspective view showing the bottom of a host board.

For all connectors 26 described herein, bottom face 94 (FIGS. 4B and 9) of the connector may be secured to host board 140. Securement may be accomplished in various ways, such as by soldering and/or with a screw. For example, terminal ends 142 (FIGS. 3D and 5C) of lower connector pins 56 and upper connector pins 102 may be soldered to host board 140. Additionally or alternatively, clips 126 may be made of metal that can be soldered onto host board 140. Additionally or alternatively, helical threads of screws 84, 85 may extend into and engage host board 140. Additionally or alternatively, screws 84, 85 may extend entirely through host board 140 to engage nuts 144 on the opposite side of host board 140, as shown in FIG. 12.

From the foregoing descriptions, an electronic assembly may comprise connector 26 and host board 140 on which connector 26 is mounted. Optionally, a plurality of electronic components may be mounted on the host board. The assembly may further include module board 20, with edge 22 of module board 20 disposed within opening 28 formed through front face 48 of connector body 27. Optionally, a plurality of electronic components may be mounted on the module board.

A method of establishing an electrical connection includes inserting module board 20 into opening 28 of connector body 27. Insertion causes module board 20 to push contact points 58 of a row of flexible connector pins 56 from a first height elevation 60 to a second height elevation 62. The method further includes rotating a first latch 66 (or 67) attached to connector body 27 from an open position to a closed position such that module board 20 is between a first upper clamp surface 68 (or 69) of the first latch and a first lower clamp surface 64 (or 65) attached to connector body 27. The first upper clamp surface is made level with third height elevation 70. The first lower clamp surface is level with second height elevation 62. Next, module board 20 is clamped between the first upper clamp surface and the first lower clamp surface by installing a screw 84 (or 85) through the first upper clamp surface and the first lower clamp surface.

While several particular forms of the invention have been illustrated and described, it will also be apparent that various modifications can be made without departing from the scope of the invention. It is also contemplated that various combinations or subcombinations of the specific features and aspects of the disclosed embodiments can be combined with or substituted for one another in order to form varying modes of the invention. Accordingly, it is not intended that the invention be limited, except as by the appended claims.

What is claimed is:

1. An electrical connector comprising:

a connector body including a body left end, a body right end, and a front face, there being an opening formed through the front face, the opening having an opening left end and an opening right end;

a row of lower connector pins located between the opening left end and the opening right end, each of the lower connector pins having a contact point such that there is a plurality of contact points, the contact points being level with a first height elevation, the lower connector pins configured to flex to allow the contact points to move from the first height elevation to a second height elevation;

a first lower clamp surface extending from the connector body, the first lower clamp surface located in front of the front face and level with the second height elevation; and a first latch attached to and configured to rotate relative to the connector body, the first latch rotatable from an open position to a closed position, the first latch including a first upper clamp surface, wherein when the first latch is at its closed position, the first upper clamp surface is at a distance away from the first lower clamp surface that is reduced from when the first latch is at its open position, the first upper clamp surface is level with a third height elevation, and the first height elevation is between the second and third height elevations.

2. The electrical connector of claim 1, wherein the first upper clamp surface is behind the front face when the first latch is at its open position, and the first upper clamp surface is in front of the front face when the first latch is at its closed position.

3. The electrical connector of claim 1, wherein either the opening left end or the opening right end is referred to as an opening end, the first upper clamp surface is located at one side of the opening end when the first latch is at its open position, and the first upper clamp surface is at an opposite side of the opening end when the first latch is at its closed position.

4. The electrical connector of claim 1, wherein the first latch is movable from the closed position to a stopped position, and wherein when the first latch is at its stopped position, the first upper clamp surface is at a distance away from the first lower clamp surface that is reduced from when the first latch is at its closed position.

5. The electrical connector of claim 4, further comprising a first lower stop surface extending from the connector body, wherein the first latch includes a first upper stop surface, the first lower stop surface and the first upper stop surface are spaced apart when the first latch is at its closed position, and the first lower stop surface and the first upper stop surface are in contact when the first latch is at its stopped position.

6. The electrical connector of claim 5, wherein a first upper through-hole extends through the first latch and the first upper stop surface, a first lower through-hole extends through the first lower stop surface, central axes of the first upper through-hole and the first lower through-hole are not aligned when the first latch is in its open position, and the central axes are aligned when the first latch is in its closed position.

7. The electrical connector of claim 6, wherein helical threads are disposed in one or both of the first upper through-hole and the first lower through-hole.

8. The electrical connector of claim 6, further comprising a first screw sized to fit into the first upper through-hole and the first lower through-hole, and helical threads are absent from one or both of the first upper through-hole and the first lower through-hole.

9. The electrical connector of claim 1, wherein the connector body includes a bottom face, the first latch includes a first tip adjacent to the first upper clamp surface, the first tip is level with a fourth height elevation when the first latch is at its closed position, and the fourth height elevation is between the third height elevation and the bottom face.

10. The electrical connector of claim 1, wherein the first upper clamp surface and the first lower clamp surface are flat, and the first upper clamp surface and the first lower clamp surface are parallel when the first latch is at its closed position.

11. The electrical connector of claim 10, wherein first upper clamp surface and the first lower clamp surface are not parallel when the first latch is at its open position.

12. The electrical connector of claim 10, wherein first upper clamp surface and the first lower clamp surface are parallel when the first latch is at its open position.

13. The electrical connector of claim 1, wherein the first latch and the first lower clamp surface are adjacent to the body left end.

14. The electrical connector of claim 1, further comprising:

a second lower clamp surface extending from the body right end, the second lower clamp surface located in front of the front face of the connector body and level with the second height elevation; and a second latch attached to the body right end and configured to rotate relative to the connector body, the second latch rotatable from an open position to a closed position, the second latch including a second upper clamp surface, wherein when the second latch is at its closed position, the second upper clamp surface is at a distance away from the second lower clamp surface that is reduced from when the second latch is at its open position, and the second upper clamp surface is level with the third height elevation.

15. The electrical connector of claim 1, further comprising a row of upper connector pins located between the opening left end and the opening right end, each of the upper connector pins having a contact point, the contact points being level with a fifth height elevation, the upper connector pins configured to flex to allow the contact points to move from the fifth height elevation to the third height elevation, and the fifth height elevation is between the second and third height elevations.

16. The electrical connector of claim 1, wherein the opening is a rectangle having a rectangle side boundary, a rectangle bottom boundary, and a rectangle top boundary, the rectangle side boundary is defined by either the opening left end or the opening right end, the rectangle bottom boundary is defined by the second height elevation, the rectangle top boundary is defined by the third height elevation, the rectangle defines a cross-section of a rectangular prism of empty space that extends in front of and into the front face of the connector body and is capable of receiving a module board.

17. The electrical connector of claim 16, wherein the first latch includes a first tip, the first tip is outside of the rectangular prism of empty space when the first latch is at its open position, and the first tip protrudes into the rectangular prism of empty space when the first latch is at its closed position.

18. The electrical connector of claim 16, wherein no part of the connector moves into or moves further into the rectangular prism of empty space when the first latch is moved from its closed position to its open position.

19. An electronic assembly comprising:

the electrical connector of claim 1; and a host board on which the electrical connector is mounted.

20. A method of establishing an electrical connection, the method comprising:

inserting a module board into an opening of a connector body, during which the module board pushes contact points of a row of flexible connector pins from a first height elevation to a second height elevation; and rotating a first latch attached to the connector body from an open position to a closed position such that the module board is between a first upper clamp surface of the first latch and a first lower clamp surface extending from the connector body, the first upper clamp surface being level with a third height elevation, and the first lower clamp surface being level with the second height elevation, and the first height elevation is between the second and third height elevations.

* * * * *